United States Patent [19]

Foltman

[11] 4,251,966

[45] Feb. 24, 1981

[54] ADJUSTABLE HEIGHT SHUTTER

[76] Inventor: Duane J. Foltman, P.O. Box 44, Zenda, Wis. 53195

[21] Appl. No.: 20,150

[22] Filed: Mar. 13, 1979

[51] Int. Cl.[3] ..... E06B 7/08

[52] U.S. Cl. ..... 52/309.1; 52/473; 52/823

[58] Field of Search ..... 52/473, 309.1, 823

[56] References Cited

U.S. PATENT DOCUMENTS

| | | | |
|---|---|---|---|
| 2,484,769 | 10/1949 | Wolters | 52/473 X |
| 3,055,467 | 9/1962 | Peek et al. | 52/473 X |
| 3,191,242 | 6/1965 | Rauen | 52/473 |
| 3,365,848 | 1/1968 | Piget | 52/823 |
| 3,394,518 | 7/1968 | Worrell, Jr. | 52/473 |
| 3,548,555 | 12/1970 | Trostle et al. | 52/473 |

FOREIGN PATENT DOCUMENTS

| | | | |
|---|---|---|---|
| 2257771 | 8/1975 | France | 52/473 |

*Primary Examiner*—Alfred C. Perham

*Attorney, Agent, or Firm*—Wheeler, House, Fuller & Hohenfeldt

[57] ABSTRACT

A shutter comprised of laterally spaced apart extruded plastic side frame members or rails having a track on their respective rear sides which extends over the length of the member. Panels, such as louvre panels, have runners which slide on the tracks in interlocking fashion to form a shutter assembly. The shutters are adjustable to any desired window or door height by cutting off parts of the runners of the louvre panels so as to eliminate one or more louvre slats and also cutting off an equal length from the frame members. The upper and lower end panels are secured with pins which pass through the frame members so the panels cannot slide from the tracks.

3 Claims, 7 Drawing Figures

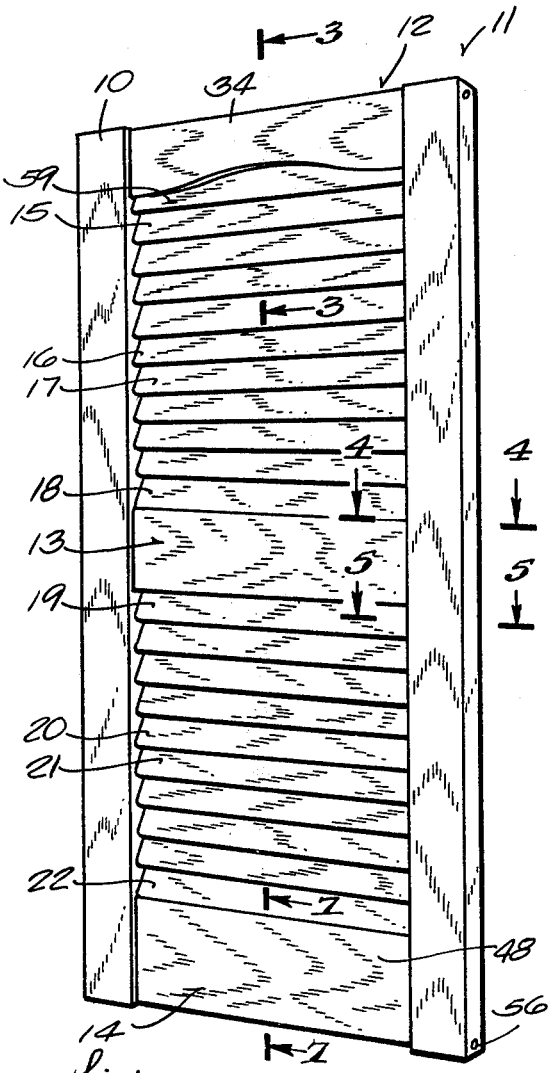
Fig. 1
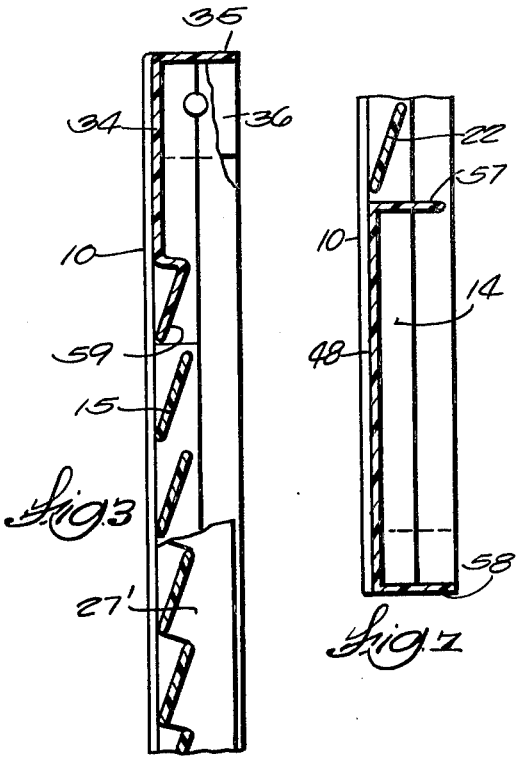
Fig. 3
Fig. 7
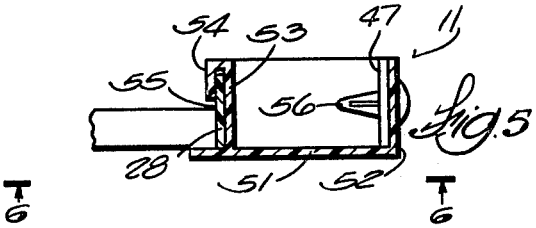
Fig. 5
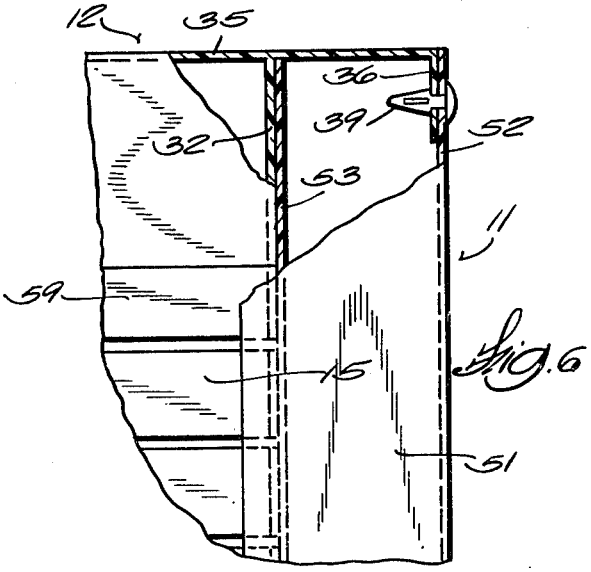
Fig. 6
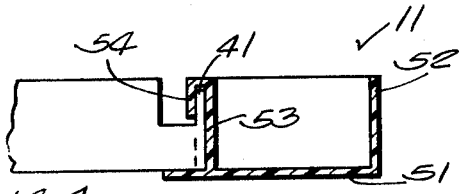
Fig. 4

ADJUSTABLE HEIGHT SHUTTER

This invention relates to shutters of the type that are installed next to doors and windows on buildings. The new shutters, which are made of rigid plastic material, simulate traditional open-louvred wooden shutters.

Traditional wooden shutters are usually fabricated in finished form in a woodworking shop and made available to builders and homeowners ready for being finished with paint or some other coating before installation on a building. Many times the height of a shutter does not match the height of the window or door and the user is unable to do anything about it because the wood pieces are usually joined together permanently with glue, dowels, nails and screws. Even if the shutters could be disassembled easily, the requisite woodworking skills are usually not readily available on the job site so the user or builder just compromises the shutter size.

Shutters made of thin aluminum sheet material are also used in some cases. These shutters may also be obtained in preassembled form which would require the service of a tradesman who was skilled in metal working practice if the height of the shutters is to be altered. Usually making alterations on the job is impractical so it is not done. Moreover aluminum shutters usually require special hardware for installing them which means that the directions for use have to be studied by an inexperienced user and that small parts have to be handled in connection with installation.

Shutters that are molded of plastic in one piece are also commercially available. It is, perhaps, needless to say that if one-piece plastic shutters are trimmed in any way to obtain a dimensional match with a particular window size, they will not even look like traditional shutters after the alteration is made.

SUMMARY OF THE INVENTION

The new adjustable type shutters described herein overcome the above-discussed problems and have other advantages too. Their height may be altered easily by anyone who has no greater skill than is required to make a few cuts with a saw or tin snips as required. The new shutters need no paint, are less expensive than wooden shutters, are decay-proof, have light-weight and are easy to install.

Briefly stated, the new shutters are comprised of side frame members, called side rails, which are extruded from a rigid plastic such as high-impact polystyrene and are usually cut to lengths approximating various window frame heights. They can be provided to the user, for instance, in 12-foot lengths if the user desired to cut them into particular lengths, but generally they are made available in shorter lengths which are closer to common window dimensions. For example, a basic length of 36 inches might be offered and greater lengths increasing in there to six-inch increments are also made available by the factory.

Each side rail has a track formed in its rear face which is coextensive with its length. In the preferred embodiment, the track is an open-sided channel. Various kinds of panels may be inserted in the tracks at the ends of the rails to span between the laterally separated vertical side rails and form a shutter. A typical panel is one having louvre slats extending between and molded integrally with flat vertically directed plastic strips called runners herein. These panels are also preferably made of high-impact polystyrene but they are made by injection molding rather than by extrusion. The runners of the louvred panel units slide into the open-sided channels or tracks from the ends of the rails to obtain an interlocking engagement with the tracks which prevents the rails from spreading apart. Panels comprising upper and lower frame members corresponding with the upper and lower cross pieces which form the frame of a wooden shutter also have runners which fit into the tracks on the side rails and these upper and lower panels are secured with manually insertable plastic split pins so the louvred panels or the other panels between the side rail members cannot slide out.

A more detailed description of a preferred embodiment of the new adjustable shutters will now be set forth in reference to the drawings.

DESCRIPTION OF THE DRAWINGS

FIG. 1 is a front perspective of an assembled shutter ready for installation on a building;

FIG. 3 is a vertical section, with parts broken away, taken on the line 3—3 near the top of the shutter, in FIG. 1, and showing a top cross panel or frame member, the runners of the top frame member and a louvre panel and some of the louvre slats in a typical louvre panel;

FIG. 4 is a partial horizontal section taken on the line 4—4 in FIG. 1, showing the top of a mullion panel and showing this panel interlocked with one of the side rails or frame members;

FIG. 5 is a partial horizontal section, taken on the line 5—5 in FIG. 1, showing one of the louvre panels interlocked in one of the side rails;

FIG. 6 is a fragmentary front elevation of the shutter portion depicted in FIG. 5 as viewed in the direction of the arrows 6—6 in FIG. 5; and FIG. 7 is a partial vertical section, taken on the line 7—7 in FIG. 1 through the lower cross rail or frame member of the shutter.

DESCRIPTION OF A PREFERRED EMBODIMENT

Figure 2:
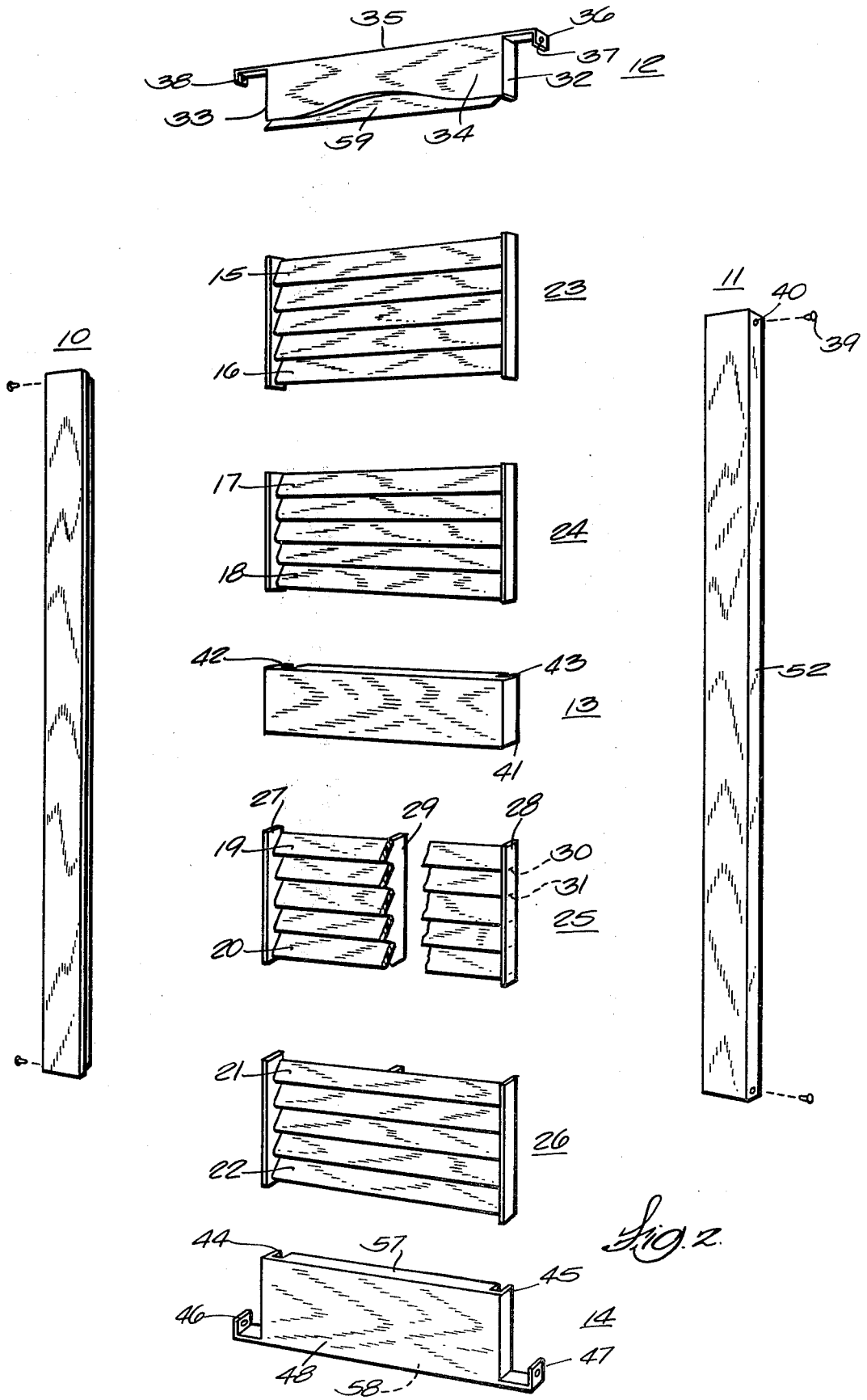
FIG. 2 is an exploded view of the shutter depicted in FIG. 1.

Referring to FIG. 1, the shutter is generally composed of a pair of laterally spaced apart vertically disposed or longitudinally extending side rails or frame members 10 and 11 and a plurality of laterally extending panel units including a top rail panel or cross member 12, a centrally located panel or cross member 13 (called a mullion), a bottom rail panel or cross member 14 and one or more modular louvre panels which have vertically separated laterally extending louvre slats such as those marked 15–22.

FIG. 2 shows an exploded view of the shutter depicted in FIG. 1. The shutter assembly is comprised of four louvre panels which are generally designated by the numerals 23, 24, 25 and 26. A typical louvre panel 25 has, in this example, five louvre slats bounded by those marked 19 and 20. These slats are molded integrally with a pair of laterally spaced apart runners 27 and 28 which are flat and uniformly rectangular in cross section over their entire vertical lengths. Other cross sectional shapes are permissible as long as the runners are shaped complementarily to the channel tracks in which they slide in the rear of side rails 10 and 11 as will be explained. Louvre panel 25, like its counterparts 23, 24 and 26, has a web 29 at its mid-section which is molded integrally with the louvre slats and contributes to stiffening the louvre panel. The unitary louvre panels 23–26 are made by the injection molding process preferably from high-impact polystyrene but other synthetic resins could also be used.

The illustrated louvre panels 23–26 happen to have five louvre slats each, but, by way of example and not limitation, they are made available in two, three and five slat versions to provide for the greatest flexibility in meeting any overall shutter height dimension that the factory or a user might want to obtain. Moreover, the runners such as 27 and 28 may be cut off to reduce the height of any louvre panel and eliminate one or more slats for the purpose of reducing the overall height of the shutter on the job site as will be discussed more fully later. This easy height adjustment is an important feature of the new shutter.

For instance, a user might find that use of four louvre panels 23–26 with five louvre slats each as in the illustrated embodiment might result in a shutter whose overall height is two or four or more inches greater than is desired to obtain dimensional harmony with the height of a window or door frame next to which the shutter is to be installed. In such cases the height of one or more louvre panels, such as panels 24 and 25 may be reduced in height by an equal amount to preserve symmetry in respect to central mullion 13. Louvre panel height reduction is easily accomplished by measuring equal distances along the side runners 27 and 28 of any louvre panel, such as 25, and scribing a line such as one of those marked 30 and 31. Then the user may easily cut through the runners 27 and 28 with a fine tooth saw or tin snips to effect removal of one or more slats, as required. Of course, a cut would also be made through web 29 just below the lower edge of the slat. In a commercial embodiment, the louvre slats are one inch apart so trimming should be made in one-inch increments. The only other thing that has to be done is to cut off an amount from the side rails 10 and 11 to compensate for the reduction in vertical length resulting from cutting the louvre panels.

As is evident in FIG. 2, all of the panels 12, 23, 24, 13, 25, 26 and 14 have runners such as those marked 27 and 28 on louvre panel 25 for engaging and interlocking with tracks on the rear of the side rails 10 and 11. Top panel or frame member 12 has runners 32 and 33 which extend rearwardly from the planar front wall 34 so this panel is essentially an open-backed box with a closed top wall 35. The top 35 of panel 12 extends laterally and forms a vertically depending tongue or flange 36 which has a small hole 37 in it. The other side of panel 12 has a similar flange 38. These flanges fit in between the outside walls such as wall 52 of side rails 10 and 11 and provide an opportunity for locking the assembled shutter together with pins such as the one marked 39 adjacent a hole 40 in side rail 11 as shown in FIG. 2. Mullion 13 is also formed with side runners 41 and 42 and at the top of mullion panel 13 is suitably notched at 43 so there is clearance on the side of the runner.

Bottom frame member or panel 14 in FIG. 2 has a front wall 48 and also has runners 44 and 45. The bottom wall of bottom panel 14 has lateral extensions terminating in flanges 46 and 47 with small holes for permitting engagement with the side rails suitable pins.

The manner in which the panel runners, such as 27 and 28 on the louvre panels and 32 and 38 on top frame panel, slide into and interlock with tracks on the vertical side rails 10 and 11 will now be described. FIG. 5 shows a cross section of one side rail 11. The rails are plastic extrusions which have a uniform cross sectional configuration over their entire lengths. The rails are desirably made of high impact polystyrene in a choice of colors but other suitable resins could be used. Typical side rail 11 has a front wall 51 which is visible when the shutter is fastened to a building. Extending rearwardly and integrally from front wall 51 are a side wall flange 52 and a flange 53 which has a re-entrant lip 54 which, in conjunction with flange 53, defines a track or channel having an open side 55 and a general configuration which is complementary to the cross sectional shape of the runner strips. The flat runner 28 of louvre panel 25 is disposed in the channel-shaped track and a aprt of one of the louvre slats 19 is shown in FIG. 5. It should be evident in FIG. 5 that runner 28 and the louvre panel 25 with which it is associated can be slid in the open-sided channel track and established anywhere along the length of side rail 11. The slats extend through the channel opening 55 as shown. When the runner 28 is pushed endwise into the open-sided channel track, the runner becomes interlocked with the track and is prohibited by lip flange 54 from being withdrawn laterally from the track. In FIG. 5, one may also see the upper end of tongue or flange 47 which extends from lower panel 14. A headed pin having a split or slotted shank 56 passes through the sidewall 52 of rail 11 and through flange 47 on lower panel 14 to secure the lower panel in place between the rails and prevent the louvre panels and mullion from sliding out of the rails when the shutter is assembled as in FIG. 1. The upper panel or frame member 12 is secured between the rails in the same manner, using its flanges 37 and 38 and split pins. It will be evident that an assembled shutter can be easily disassembled by removing the four pins and sliding the louvre and mullion panels out of the rails as one would do when changing the height of a preassembled shutter is contemplated.

FIG. 7 shows a vertical section of bottom panel 13 where it is apparent that this panel has a channel configuration having upper and lower flanges 57 and 58. Flange 58 closes the bottom of panel 13 and contributes to the appearance of this part of the shutter having been made of natural solid wood.

FIG. 4 shows a runner 41 of mullion panel 13 similarly interfitted in the open-sided channel or track defined by flange 53 and re-entrant lip 54. Mullion 13 is, of course, interposed between louvre panels as is evident in FIGS. 1 and 2 to produce a shutter that looks like a traditional wooden shutter since mullions are often used in them.

The manner in which the top panel 12 interconnects with a side rail 11 can be seen in FIGS. 3 and 6. FIG. 6 is a fragment of the uper right corner region of the assembled shutter shown in FIG. 1 with some parts in section. In FIG. 6, the runner 32 of top panel 12 is installed in the open-sided track and downwardly depending fastening flange 36 is juxtaposed to and against the outside flange or wall 52 of side rail 11. A split pin 39, previously shown in FIG. 2, assists in holding this panel in place and the panel keeps the louvre panels in place and further contributes to rigidifying the shutter after it is assembled. Note also in FIGS. 1, 2, 3 and 6 that a louvre slat 59 is molded integrally with the front face 34 of upper frame member or panel 12 so there will be not extra large gap among the louvre slats and they will exhibit uniform spacing.

Assembly of the shutter parts to form a finished product ready for installation on a building should be evident from the drawings. All that is involved is to push the runners of the various panels into the ends of the open-sided channels or tracks on the side rails 10 and 11, with or without the use of a mullion panel if desired, and then inserting the top and bottom frame panels 12 and 14 into the rails. The four snap pins are then pushed through the holes in the ends of the rails and into the flanges such as 36, 38, 46 and 47 on the top and bottom end panels and a rigid shutter is obtained. The thickness of the runners is just slightly less than the width of the channels or tracks on the side rails so there is no significant free play or wobble and the shutter feels very rigid when it is handled.

The new shutter is notable for its size and color versatility and natural wood appearance. The various panels are made available in different colors so a user can develop any desirable color scheme of the commonly available trim color combinations which could be obtained with wood that has been painstakingly painted. For example, the frame members or side rails 10 and 11 and the top and bottom panels 12 and 14, and the mullion 13 might be of another color. In the commercial product, the front surfaces of all parts which are visible to an observer are embossed in a manner to simulate natural wood grain which has been covered with paint. All of the parts are coated with a latex water-based liquid which becomes insoluble after curing and which filters the sun's ultraviolet rays so that color fading and any other degradation of the polystrene resin will be suppressed.

Because of their light weight and rigidity, the shutters are easy to install on a building. Usually this simply involves having the installer drill holes, not shown, near the ends of the side rails perpendicularly through their faces. Screws, not shown, are then turned in these holes to fasten the shutter to the building.

In summary, the new shutters take all of the guesswork out of choosing the exact size shutter required to match a particular window or door size. They are adjustable from both the top and bottom in one-inch intervals in the preferred embodiment, with a minimum of time and skill being required. The slideable and interlocked panel concept is not only applicable to louvred shutter assemblies as described above, but is also applicable to other panel structures which might be used to enhance the esthetic qualities of any part of a building.

Although the new shutters have been described in considerable detail, such description is intended to be illustrative rather than limiting, for the basic concepts described above may be variously implemented and are to be limited only by interpretation of the claims which follow.

I claim:

1. A shutter that is characterized by the ease with which its height may be adjusted comprises:

a pair of extruded plastic side rails having uniform cross sectional configuration over their entire lengths, said cross sectional configuration being defined by a flat front wall having outer and inner vertically extending edges, an outer side wall flange extending rearwardly from the outer edge of the front wall, another flange extending rearwardly from said front wall and laterally spaced from said side wall flange and set back from said inner edge so the marginal region of said front wall extends inwardly of said other flange and provides a planar surface facing toward the rear, a re-entrant lip spaced from said other flange in a manner to define a single open-sided and open-ended channel track coextensive with the lengths of the side rails with its side opening facing toward said planar surface, a louvre panel molded of plastic, said louvre panel comprising a plurality of spaced apart louvre slats in substantial parallelism with each other and laterally spaced apart runners to which opposite corresponding ends of said slats are respectively connected, said runners having a cross sectional configuration that is substantially complementary to the shape of said channel of said track to enable said runners on one or more louvre panels to be slid into and along said track and between said track and said planar surface with said slats extending through the respective side-openings to compose the body of a shutter, said runners on said louvre panels being comprised of plastic strips which are thin enough to be easily cut for removing one or more louvre slats and said rails are thin enough to be easily cut for shortening the lengths of said rails by an amount cut from said runners, to thereby enable the overall height of the shutter to be reduced, top and bottom end panels for composing the frame of said shutter in cooperation with said side rails, said end panels each having a front wall and laterally spaced apart side walls extending rearwardly and integrally from the front wall, said side walls serving as runners for sliding in said track channel and having a cross sectional configuration that is complementary to that of said channel, said end panels having top and bottom walls, respectively, and lateral extensions of said walls which extend to said side wall flanges of said rails to close the respective tops and bottoms of said end panels and to provide means for fastening said end panels in said rails, insertion of said end panel runners in said channels constraining said louvre panels against sliding from said channels, said lateral extensions having flanges for extending in juxtaposition with said side wall flanges of said rails to enable passing the shanks of fasteners through said last named flanges and rail side wall for holding said shutter together.

2. The shutter as claimed in claim 1 wherein said side rails are extruded from polystyrene and said panels are molded from polystyrene.

3. The shutters as claimed in claim 1 wherein said louvre panels are molded from polystyrene.

* * * * *